United States Patent [19]

Maleyko

[11] Patent Number: 5,054,778

[45] Date of Patent: Oct. 8, 1991

[54] LIGHTED BALL

[76] Inventor: John R. K. Maleyko, 609 Belle River Rd., Belle River, Ontario, Canada, N0R 1A0

[21] Appl. No.: 642,830

[22] Filed: Jan. 18, 1991

[51] Int. Cl.[5] ..... A63B 43/06; A63H 33/26

[52] U.S. Cl. ..... 273/58 G; 446/425; 446/439; 362/190; 273/DIG. 8

[58] Field of Search ..... 273/58 R, 58 A, 58 B, 273/58 BA, 58 F, 58 G, 58 J, DIG. 20, DIG. 8; 446/484, 485, 438, 439; 362/190

[56] References Cited

U.S. PATENT DOCUMENTS

| | | | |
|---|---|---|---|
| 2,020,484 | 11/1935 | Turner | 273/58 G X |
| 2,647,222 | 7/1953 | Nieset | 446/485 X |
| 3,458,205 | 7/1969 | Smith et al. | 273/58 G |
| 3,580,575 | 5/1971 | Speeth | 273/58 G |
| 3,804,411 | 4/1974 | Hendry | 273/58 G |
| 3,935,669 | 2/1976 | Potrzuski et al. | 273/58 G X |
| 4,002,893 | 1/1977 | Newcomb et al. | 273/58 G X |
| 4,701,146 | 10/1987 | Swenson | 273/58 G X |
| 4,776,589 | 10/1988 | Yang | 273/58 G |
| 4,867,727 | 9/1989 | Lanius | 446/242 |

*Primary Examiner*—George J. Marlo

*Attorney, Agent, or Firm*—Reising, Ethington, Barnard, Perry & Milton

[57] ABSTRACT

A lighted ball having high velocity bounce capability which comprises a solid spherical body of soft, pliable, transparent rubber having a plurality of LEDs embedded in the body. An electrical switch with push button action is embedded in the body and connected in circuit with a battery set for energizing the LEDs. The removable closure is provided in a battery passage. A switch access passage extends from the switch actuator to the surface of the body.

5 Claims, 1 Drawing Sheet

LIGHTED BALL

FIELD OF THE INVENTION

This invention relates to amusement devices and more particularly, it relates to a lighted ball for throwing, catching and bouncing.

BACKGROUND OF THE INVENTION

In the past, it has been proposed to provide amusement balls with interior lights for various purposes. Such prior art devices, however, leave much to be desired in respect to the amusement function, durability and long life.

A ball with selectively operable lights responsive to impact is described in Speeth U.S. Pat. No. 3,580,575 granted May 25, 1971. This ball is constructed with a hollow transparent wall which accommodates a set of three colored incandescent lamps. The hollow portion may be filled with a transparent resin. The lamps are carried on a circuit board with an impact responsive switch for turning one of the lights on in response to impact. One or more batteries are disposed inside the ball and may be provided with recharging terminals at the surface of the ball.

An internally lighted ball is also disclosed in the Hendry U.S. Pat. No. 3,804,411 granted Apr. 16, 1974. The ball of this patent is constructed of two hemispherical parts each of which is hollow except for a cylindrical tube which is attached internally to the wall of the hemisphere. The two tubes are threadedly engaged to join the two parts into a spherical body. A pair of batteries are carried within the cylindrical tubes and connected with an incandescent lamp which is inside the ball.

A ball combined with a lamp and switches is described in the Potrzuski et al. U.S. Pat. No. 3,935,669 granted Feb. 3, 1976. The ball is provided with a circuit including a battery, one or more centrifugal switches and a light bulb which is turned on when the ball undergoes certain rotary motion and is turned off when the bulb is at rest. An amusement device in the form of a yoyo with an interior light and cylindrical switch and battery is shown in the Lanius U.S. Pat. No. 4,867,727 granted Sept. 19, 1989.

A spherical rattle for an infant is disclosed in the Swenson U.S. Pat. No. 4,701,146 granted Oct. 20, 1987. In this device, plural LEDs are connected in circuit with reed switches so that the LEDs are selectively turned on and off in response to motion of the spherical rattle. In a cylindrical embodiment of the rattle, a push button switch is provided with an actuator externally of the handle which can be manually actuated to enable or disable the energization of the LEDs. An inflatable ball with plural interior lights is described in the Yang U.S. Pat. No. 4,776,589 granted Oct. 11, 1988. In this device, the battery cell holder with a manually actuable switch is insertable into a hollow compartment of the ball which is closed by a waterproof closure at the exterior surface of the ball.

A general object of this invention is to provide an improved lighted ball which provides a high energy, high velocity bounce capability like that of the well-known "Super Hi-Bounce Ball" bouncing ball of high elasticity material and to overcome certain disadvantages of the prior art lighted balls.

SUMMARY OF THE INVENTION

In accordance with this invention, a lighted ball is provided which comprises a spherical body of soft, pliable, transparent rubber capable of high velocity and high energy bounce upon impact and which carries a battery powered lighting circuit with manual switching to conserve the energy drain of replaceable batteries.

Further, in accordance, with this invention, an amusement device is provided with comprises a spherical body of soft, pliable, transparent material having a plurality of LEDs embedded in the body, an electrical switch embedded in the body and connected in circuit with the terminals of a battery set for energizing the LEDs through the switch. A removable closure is provided in a battery access passage and a switch access passage extends from a push-responsive switch actuator to the surface of the body and is adapted to receive a slender rod-like device for pushing the switch actuator.

Further, in accordance with the invention, the removable closure is provided with a tool receiving socket on the exterior surface and includes a mechanical interlock for inhibiting reverse rotation of the closure.

Further, in accordance with the invention, the spherical body comprises two identical hemispherical parts joined together and having opposed recesses in the flat face of each hemispherical part to accommodate the LEDs, the battery compartment, the electrical switch and the electrical conductor means.

A complete understanding of this invention may be obtained from the detailed description that follows taken with the accompanying drawings.

BEST MODE FOR CARRYING OUT THE INVENTION

Figure 3:
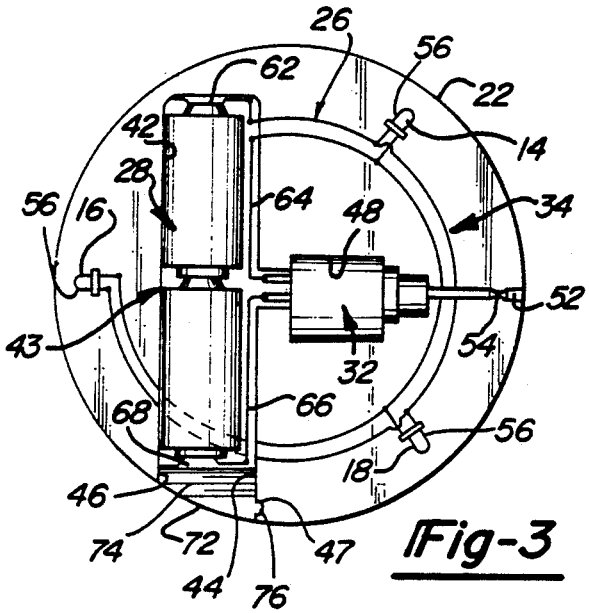
FIG. 3 is a view of the flat face of one of the hemispherical parts of FIG. 1 showing the interior components of the ball of this invention.

Referring now to the drawings, the invention is illustrated in a particular embodiment of a lighted ball constructed of transparent rubber. It will be understood as the description proceeds that the invention may be realized in different embodiments and may be used in various ways.

Figure 1:
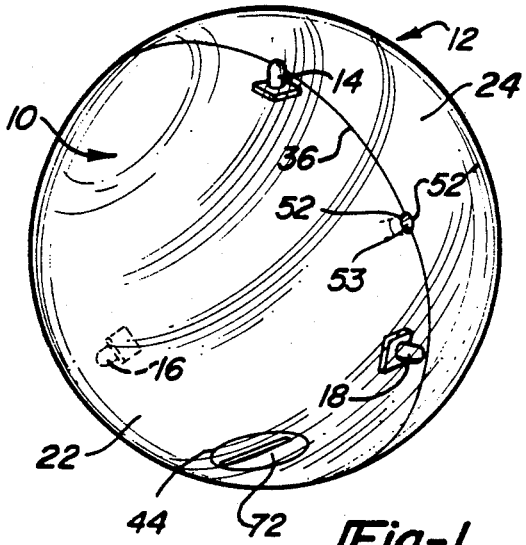
FIG. 1 is a perspective view of the ball.

As shown in FIG. 1, the amusement device or lighted ball 10 comprises a spherical body 12 with a set of three interiorly disposed LEDs 14, 16 and 18. The spherical body 12 is soft and pliable and has a high degree of elasticity and bounces well upon impact with a floor, wall or driveway or the like of ordinary construction. The spherical body 12 is constructed of a synthetic rubber. Preferably the material is polyurethane such as that sold under the trademark "KRAYTON". The body is permeable to light emitted by the LEDs and is preferably transparent with a high degree of light transmission. The polyurethane material is preferably clear but may be suitably tinted with a pigment to provide a desired tint. As will be described subsequently, the body 12 is solid, i.e. not hollow, except for the embedment of the components for lighting the ball. The LEDs 14, 16 and 18 are all preferably of the same color, e.g. red, but may be of two or three different colors. Preferably, the ball is about three inches in diameter and is comfortably hand held for throwing, catching and bouncing. Desirably, the spherical body 12 exhibits behavior in bouncing, throwing and catching very much like the well-known "Super Hi-Bounce Ball".

Figure 2:
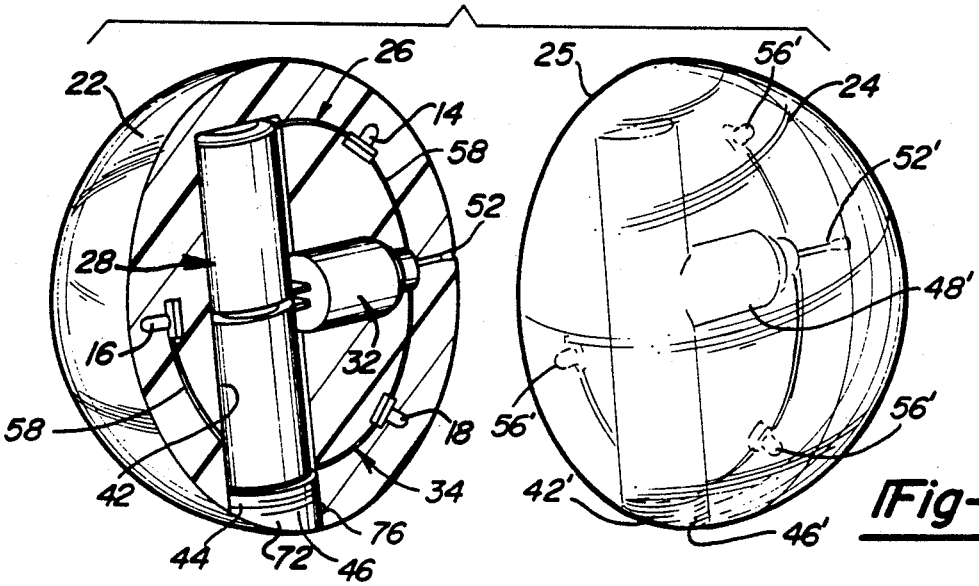
FIG. 2 is a perspective view of the two hemispherical parts of the ball of this invention.
Figure 4:
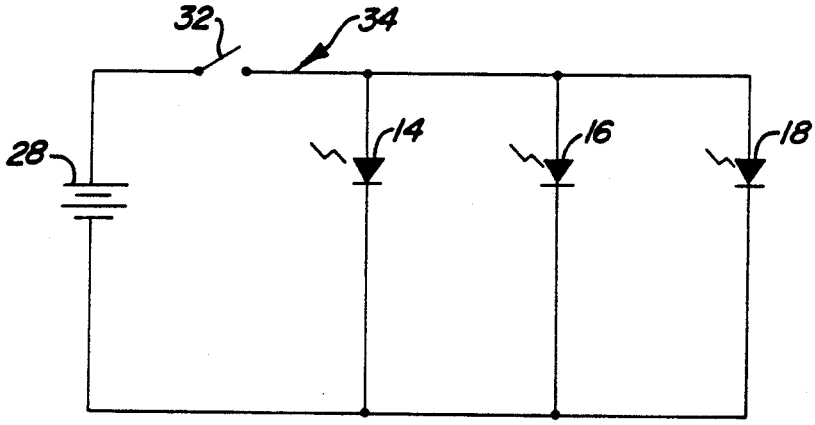
FIG. 4 is a schematic diagram of the electric circuit of the ball.

The spherical body 12 is comprised of first and second hemispherical parts 22 and 24 as best illustrated in FIG. 2. The spherical parts 22 and 24 are mirror images of each other and each is formed by molding. The LED circuit 26, shown schematically in FIG. 4, is embedded in the spherical body 12, preferably by nesting the components of the LED circuit 26 between the hemispherical parts 22 and 24. As shown in FIGS. 2, 3 and 4, the LED circuit 26 comprises a battery set 28, a switch 32, LEDs 14, 16 and 18, and the circuit conductor 34. The switch 32 is a single pole, single throw switch with a spring-loaded push rod actuator which opens and closes the switch on alternate strokes. As shown in FIGS. 2 and 3, approximately one-half of each of the components of the LED circuit 26 is nested in recesses in the flat face of hemispherical part 22 and the other half of each of the components is nested in the flat face of the hemispherical part 24. By this construction, the parts 22 and 24 can be molded using the same female mold member for each of the parts 22 and 24 and, except for one non-symmetrical portion (recess 44), the same male mold member can be used for each of the parts 22 and 24. The spherical body 12 is formed from the two hemispherical parts after the components of the LED circuit 26 are positioned in the respective nests by joining the flat faces of the parts 22 and 24. Preferably this is accomplished by a silicone adhesive, preferably an industrial grade clear silicone material, to form a bond 36 between the parts. In high volume production of the lighted ball 10, a preferable bonding technique is that of electromagnetic welding of the flat faces in accordance with known bonding techniques.

As shown in FIGS. 2 and 3, the hemispherical part 22 is provided with a battery recess 42 of semi-cylindrical shape. The recess 42 is spaced at its inner end from the surface of the body 12 by about one-fourth inch and at its outer end the recess 42 terminates at about one-fourth inch from the surface of the body. The outer end of the recess 42 is connected through a plug recess 44 to the surface of the body. The plug recess 44 is also semi-cylindrical and is provided on its surface with a screw thread 46. The flat face of the hemispherical part 22 is also provided with a switch recess 48 which is semi-cylindrical and extends perpendicular to the battery recess 42. The switch recess 48 is connected with the battery recess 42 by portion of reduced diameter to accommodate the terminals of the switch 32. The switch recess 48 is also connected through a switch actuator recess 52 to the surface of the hemispherical part 22. The recess 52 is also semi-cylindrical in cross-section and is provided with a throat section 54 of reduced radius with the center of the throat section being about two or three-thousandths of an inch radius whereas the largest radius of the throat is about one-eighth inch. Also, the flat face of the hemispherical part 22 is provided with three LED recesses 56 which are adapted to receive the LEDs 14, 16 and 18, respectively. Preferably, the recesses 56 are equally spaced in the circumferential direction and in cross-section are semi-cylindrical to provide a nest which accommodates one-half of the respective LED and its lead wires. Also, the flat face of the hemispherical part 22 is provided with a conductor recess 58 which is suitably semi-cylindrical in cross-section and which extends in a circular pattern from the battery recess 42. The conductor recess 58 is suitably cylindrical in cross-section and extends in a circular path from the battery recess 43 to the three LED recesses of 56 and succession to accommodate the circuit conductor 34 which connects the LEDs together.

As shown in FIG. 2, the hemispherical part 24 is provided on its flat face 25 with a set of recesses 42', 44', 46', 48' and 52' which are complementary to and of the same configuration as and disposed respectively opposite the recesses 42, 44, 46, 48, 50 and 54 just described. When the hemispherical parts 22 and 24 are disposed in face-to-face engagement to form the spherical body 12, the recesses 42 and 42' form a battery compartment 43 and the plug recesses 44 and 44' form a battery passage 45. Similarly, the switch recesses 48 and 48' form a switch compartment 49 and the actuator recesses 52 and 52' form an actuator passage 53. The throat sections 54 and 54' form a throat 55 in the passage 53. Further, when the semi-cylindrical parts 22 and 24 are placed face-to-face, the LED recesses 56 and 56' form LED compartments 57 and the conductor recesses 58 and 58' form a conductor raceway 59.)

Before the hemispherical parts 22 and 24 are bonded together to form the spherical body 12, certain of the components of the LED circuit 26 are installed in the respective recesses in one of the hemispherical parts, say part 22. This includes the circuit conductor 34, the LEDs 14, 16 and 18, and the switch 32, which are electrically connected together, as shown in FIG. 3, and which constitute a subassembly. The circuit conductor 34 comprises a battery compartment terminal 62 in the form of a disk-shaped member which is suitably press fitted into the inner end of the battery recess 42. The battery terminal 62 is electrically connected by a wire conductor 64 to one terminal of the switch 32. The other terminal of the switch is connected through a wire conductor 66 to one terminal of each of the LEDs 14, 16 and 18. A second battery compartment terminal 68, suitably of disk-shape is loosely disposed in the outer end of the battery recess 42 and it is connected through a wire conductor 72 to each of the other terminals of the LEDs 14, 16 and 18. With these components installed in the hemispherical part 22, the other hemispherical part 24 can be joined in face-to-face relation to the part 22.

For joining the parts 22 and 24, a suitable adhesive or bonding material, preferably an industrial grade clear silicone resin is applied to the flat face of each hemispherical part and the parts are placed in face-to-face engagement with the complementary recesses in proper alignment. If desired, any voids in the recesses not occupied by the circuit conductor or other components may be filled with the resin to immobilize and protect the circuit components. After the parts are thus placed in engagement, the resin is appropriately cured to complete the bonding of the hemispherical part.

In this condition, the ball 10 is completed by the installation of the battery set 28 and the battery plug 72. The plug 72 is constructed of the same material as the hemispherical parts 22 and 24 of the ball and is separately molded as a unitary body. The plug 72 is provided with a screw thread 74 which mates with the screw thread 46. Thread 74 is provided with a detent element 76 which coacts with a mating detent element 47 in the thread 46 to inhibit unscrewing of the plug. When the battery set 28 is installed into the battery compartment 43, the compartment terminal 68 is held out of the way by flexing the conductor 72 and then placed it in position at the end of the battery set before the plug 72 is screwed into the threaded battery passage 45. The plug is tightened until the detent elements are engaged to form a mechanical interlock to thereby inhibit unscrewing of the plug. This tightening of the plug ensures that the proper electrical contact will be made with the battery set. The battery plug 72 is provided with a tool receiving recess, suitably a slot for a conventional screw driver on its outer surface. The outer surface of the plug is formed with spherical curvature so that it conforms to the outer surface of the ball 12 when it is tightened into place. The battery set 28 is preferably a pair of N-size batteries which may be of the alkaline cell type which have a nominal voltage of one and one-half volts. The two N-size batteries are connected in series in the battery compartment and the output voltage of three volts is suitable for energizing the LEDs in parallel circuit connection. Battery set 28 can be replaced when needed by unscrewing the plug 72 and installing new batteries.

With the batteries installed, the ball 10 is in readiness for use. As shown in the circuit diagram of FIG. 4, the three LEDs 14, 16 and 18 are connected in parallel with each other and in series with the battery set 28 through the switch 32. When the switch 32 is open, all of the LEDs are deenergized and when the switch is closed all of the LEDs are energized. When the ball is not in use, the switch 32 should be open to avoid battery drain. When it is desired to use the ball, the switch 32 is actuated by inserting a thin rod-like tool, or suitably a pencil tip, into the actuator passage 33 to engage the actuator 33 of the switch 32. When the rod-like tool is inserted into the passage 53, the pressure thereon will enlarge the throat by slight deformation and the tool will engage the push rod actuator 33 of the switch to close the switch and turn on the LEDs. When the use of the ball is ended, the switch may be opened by the same operation.

With the ball in the lighted condition, especially with dark or subdued ambient light, the ball exhibits a colorful and fascinating appearance, especially when in motion as when thrown or bounced. Because of the properties of the rubber of the ball, it bounces with high velocity and the rotation of the ball causes light from the LEDs to provide a brilliant display of rapidly changing and moving points of light along the path of the ball.

Although the description of this invention has been given with reference to a particular embodiment, it is not to be construed in a limiting sense. Many variations and modifications will now occur to those skilled in the art. For a definition of the invention reference is made to the appended claims.

What is claimed is:

1. An amusement device for throwing, catching and bouncing comprising:

a solid spherical body of soft pliable transparent rubber having a high degree of elasticity for providing said body with high velocity bounce capability, a plurality of LEDs embedded in said body in spaced relation with each other, an electrical switch embedded in said body and having a push responsive switch actuator for operating said switch between open and closed positions, a battery compartment in said body adapted to receive a battery set with first and second electrical terminals adapted to be engaged by battery terminals of said battery set, electrical conductor means in said body connecting said electrical terminals and said switch in series with each other and for connecting said LEDs with said battery set through said switch, said battery compartment having a battery access passage extending therefrom to the exterior surface of said body for removal and replacement of said battery set, a removable closure in said battery access passage and having an outer surface conforming to the surrounding exterior surface of said body, said LEDs, switch, actuator, conductor means and said battery compartment being disposed entirely inside the exterior surface of said body, and a switch access passage extending from said switch actuator to the exterior surface of said body and being adapted to receive a slender rod-like tool for pushing said switch actuator.

2. The invention as defined in claim 1 wherein said removable closure threadedly engages the wall of said battery access passage and has a tool receiving socket on the exterior surface thereof, said closure being effective to seal said passage against entry of foreign particulate matter and water and wherein said removable closure includes a mechanical interlock for inhibiting reverse rotation of said closure.

3. The invention as defined in claim 2 wherein said switch access passage includes a throat portion of reduced diameter which is elastically enlarged by insertion of said rod-like tool.

4. The invention as defined in claim wherein said rubber is polyurethane rubber.

5. The invention as defined in claim 1 wherein said spherical body comprises two identical hemispherical parts joined together and having opposed recesses in the flat face of each hemispherical part to accommodate said LEDs, said battery compartment, said electrical switch and said electrical conductor means.

* * * * *